US007455286B2

(12) United States Patent
Klaffenbach et al.

(10) Patent No.: US 7,455,286 B2
(45) Date of Patent: Nov. 25, 2008

(54) SHEET SEPARATION USING TWO TORQUE MOTORS

(75) Inventors: David K. Klaffenbach, Battle Ground, WA (US); Gary L. Miller, Vancouver, WA (US); Jeffrey S. Mathena, Vancouver, WA (US); Christopher M. Lesniak, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 449 days.

(21) Appl. No.: 11/169,062

(22) Filed: Jun. 28, 2005

(65) Prior Publication Data

US 2007/0007710 A1 Jan. 11, 2007

(51) Int. Cl.
*B65H 3/06* (2006.01)

(52) U.S. Cl. ..... 271/114; 271/122; 271/125

(58) Field of Classification Search ..... 271/114, 271/122, 125, 10.09, 10.11
See application file for complete search history.

(56) References Cited

U.S. PATENT DOCUMENTS

| | | | | |
|---|---|---|---|---|
| 5,435,537 | A | 7/1995 | Gysling | |
| 5,435,540 | A * | 7/1995 | Martin et al. | 271/122 |
| 5,725,206 | A | 3/1998 | Sugiyama | |
| 6,155,556 | A * | 12/2000 | Lynch et al. | 271/117 |
| 6,164,641 | A * | 12/2000 | Harada et al. | 271/198 |
| 2001/0020765 | A1 * | 9/2001 | Araki et al. | 271/125 |
| 2002/0020959 | A1 * | 2/2002 | Matsuda et al. | 271/122 |
| 2002/0127037 | A1 | 9/2002 | Fujii | |
| 2003/0067108 | A1 | 4/2003 | Marra, III et al. | |
| 2003/0118385 | A1 | 6/2003 | Isemura et al. | |
| 2003/0184002 | A1 | 10/2003 | Akiyama et al. | |
| 2004/0041854 | A1 | 3/2004 | Saito et al. | |
| 2004/0046310 | A1 | 3/2004 | Miki | |
| 2004/0188919 | A1 * | 9/2004 | Sakamaki et al. | 271/122 |
| 2005/0012769 | A1 | 1/2005 | Hanabusa et al. | |
| 2005/0082739 | A1 * | 4/2005 | Mitsuya et al. | 271/10.11 |
| 2007/0126171 | A1 * | 6/2007 | Takeuchi et al. | 271/121 |

* cited by examiner

*Primary Examiner*—Patrick H Mackey
*Assistant Examiner*—Gerald W McClain

(57) ABSTRACT

Various embodiments of a sheet separation system are disclosed.

30 Claims, 5 Drawing Sheets

SHEET SEPARATION USING TWO TORQUE MOTORS

BACKGROUND

In many devices, media may be supplied as a stack of sheets. Individual sheets are picked from the stack for interaction. In some instances, multiple sheets are picked. The picking of multiple sheets may lead to mishandling of the media, jams, waste and user inconvenience.

DETAILED DESCRIPTION OF EXAMPLE EMBODIMENTS

Figure 1:
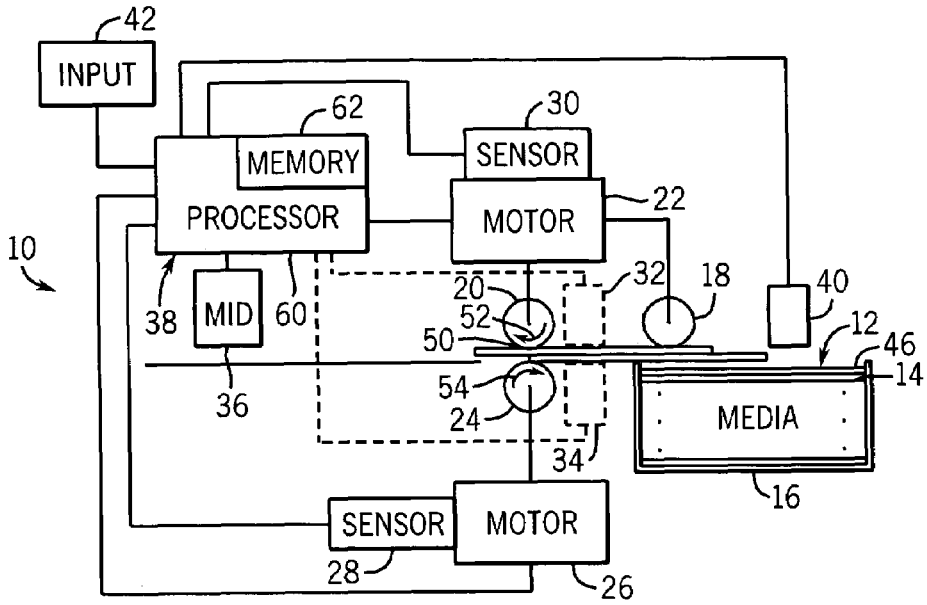
FIG. 1 is a schematic illustration of an example of a sheet separation system according to one example embodiment.

FIG. 1 schematically illustrates sheet separation and interface system 10 according to one example embodiment. System 10 is configured to pick individual sheets 12 from a stack 14 of media and to interact with such media by writing or printing to the media and/or by scanning or reading information from the media. System 10 generally includes media input 16, pick device 18, media driver 20, motor 22, media driver 24, motor 26, sensor 28, sensor 30, sensors 32, 34, media interaction device 36, controller 38, sensor 40 and input 42. Media input 16 comprises a structure configured to store and supply stack 14 of sheets 12 of media. In one embodiment, media input 16 comprises a feed tray upon which a stack of media is stored and potentially aligned for picking by pick device 18. Although media input is illustrated as containing and supporting sheets 12 while sheets 14 are arranged in a generally horizontal stack 14, media input 16 may alternatively be configured to support sheets 12 stacked in other orientations. For example, in other embodiments, media input 16 may be configured to support sheets 12 arranged in a substantially vertical or in an inclined stack 14.

Pick device 18 comprises a device configured to engage a face 46 of a sheet 12 to move sheet 12 from stack 14 to media drive members 20, 24.

Media drive member 20 comprises one or more members configured to engage face 46 of a sheet 12 of media so as to apply force to a sheet 12 of media in a direction away from media input 16. In one embodiment, media drive member 20 comprises a roller having a media engaging surface 50. In other embodiments, media drive member 20 may include multiple rollers, a belt configured to engage sheet 12 or other mechanisms configured to engage and move sheet 12 away from input 16 towards media interaction device 36.

Motor 22 comprises a mechanism configured to apply torque, and to provide rotational power, to media drive member 20 such that media drive member 20 applies force to an engaged sheet 12 in a direction away from media input 16 and towards media interaction device 36. In the particular example illustrated, motor 22 applies torque to media drive member 20 in the direction indicated by arrow 52. In one embodiment, motor 22 comprises a DC motor. In other embodiments, motor 22 may comprise other forms of motors.

Media drive member 24 comprises a mechanism configured to apply force to one or more sheets 12 of media in a direction towards media input 16. Media drive member 24 is located opposite to media drive member 20. In one embodiment, media drive member 24 is located directly opposite to media drive member 20. In another embodiment, media drive member 24 may be staggered or offset with respect to media drive member 20 on an opposite side of one or more sheets 12 of media between members 20 and 24. In one embodiment, media drive member 24 comprises one or more rollers. In other embodiments, media drive member 24 may comprise one or more belts or other structures configured to engage and apply force to one or more sheets 12 of media between members 20 and 24.

Motor 26 comprises a mechanism configured to apply torque, and to provide rotational power, to media drive member 24. In particular, motor 26 comprises a device configured to apply torque to media drive member 24 in the direction indicated by arrow 54 generally opposite to the direction 52 of torque supplied to media drive member 20 by motor 22. In one embodiment, motor 26 comprises a DC motor. In other embodiments, other forms of motors may be employed.

Sensor 28 comprises a device configured to facilitate control of motor 26 such that the torque applied by motor 26 to media drive member 24 may be maintained or adjusted. In one embodiment, sensor 28 comprises a device configured to sense a rotational velocity of an output shaft of motor 26 or another shaft operably coupled between motor 26 and media drive member 24. Based upon the sensed rotational velocity of the shaft and a voltage applied to motor 26, controller 38 or another controller may determine torque being applied to motor 26 as well as the current being applied to motor 26. Using such information, controller 38 may make adjustments to control voltage supplied to motor 28 to control torque supplied by motor 26 to media drive member 24. For example, motor 26 may be maintained at a constant torque or such that motor 26 applies torque and pulses having varying frequencies or duty cycles. In one embodiment, sensor 28 comprises an encoder, such as a quadrature encoder. In other embodiments, other sensors may be employed.

Sensor 30 is similar to sensor 28. In particular, sensor 30 comprises a device configured to facilitate control of motor 22 and the torque applied by motor 22 to media drive member 20. In the embodiment illustrated, sensor 30 is configured to sense or detect rotational velocity and direction of an output shaft of motor 22 or another shaft operably coupled between motor 22 and media drive member 24. Based upon the detected rotational velocity of the shaft as well as the voltage applied to motor 22, controller 38 or another controller may determine the current torque being applied by motor 22 to media drive member 20. Using such feedback, controller 38 may adjust the voltage applied to motor 22 to also adjust and control the torque applied by motor 22 to media drive member 20. In one embodiment, controller 38 may serve as a servo system using sensor 30, calculating a correct current, voltage and pulse-width modulation based on a series of calculations to control torque being applied by motor 22. For example, motor 22 may be operated so as to apply a constant torque to media drive member 20 or may alternatively be operated so as to modulate applied torque with a desired frequency and duty cycle. In one embodiment, sensor 30 comprises an encoder, such as a quadrature encoder. In other embodiments, sensor 30 may comprise other sensing devices.

Sensors 32 and 34 comprise sensing devices configured to sense movement of one or more sheets 12 of media therebetween as the one or more sheets of media are being driven by media drive members 20 and 24. Sensors 32 and 34 are in communication with controller 38 for determination of whether a single sheet 12 or multiple sheets 12 have been picked by pick device 18 and are being engaged by media drive members 20 and 24. In particular embodiments, control 38 may adjust the operation of motor 22 and/or motor 26 based upon whether a single sheet 12 or multiple sheets 12 have been picked by pick device 18 as determined from signals receiving from sensors 32 and 34. In one embodiment, sensors 32 and 34 may each comprise optical sensors. In other embodiments, sensors 32 and 34 may comprise mechanical flags or sensing devices. As indicated in phantom, sensors 32 and 34 may be omitted in some embodiments, such as those where the torque supplied to media drive members 20 and 24 by motors 22 and 26, respectively, is not adjusted as a result of multiple sheets 12 being picked or in embodiments where picking of multiple sheets 12 by pick device 18 is detected utilizing signals from one or both of sensors 28 and 30 as will be described in greater detail hereafter.

Media interaction device 36 comprises a device configured to interact with media supplied from media input 16. In one embodiment, media interaction device 36 comprises a device configured to write data or information to sheets 12 of media. For example, in one embodiment, media interaction device 36 may comprise one or more inkjet printheads configured to deposit ink or other printing material upon sheets 12. In one embodiment, media interaction device 36 may comprise an array of printheads extending across media 12. In other embodiments, media interaction device 36 may comprise one or more printheads movable across media 12 by a carriage. In still other embodiments, media interaction device 36 may comprise a device configured to read or scan information, data or printing from sheets 12. The device 36 may alternatively comprise an electrostatic print engine in some embodiments.

Controller 38 comprises a device configured to generate control signals directing the operation of motor 22 and motor 26. In one embodiment, controller 38 is further configured to generate control signals directing the operation of media interaction device 36. Controller 38 generally includes processor 60 and memory 62. Processor 60 comprises a processing unit. For purposes of this disclosure, the term "processing unit" shall mean a conventionally known or future developed processing unit that executes sequences of instructions contained in a memory. Execution of the sequences of instructions causes the processing unit to perform steps such as generating control signals. The instructions may be loaded in memory 62.

Memory 62 comprises a computer readable medium containing instructions for processor 60. Memory 62 may be fixed with respect to processor 60 or may be portable with respect to processor 60 and system 10. Memory 62 may comprise a random access memory (RAM) for execution by the processing unit, a read only memory (ROM), a mass storage device, or some other persistent portable (tape, disc and the like) or fixed storage. In other embodiments, hard wired circuitry may be used in place of or in combination with software instructions to implement the functions described. In the particular example illustrated, memory 62 includes instructions for processor 60 for directing motor 22 to apply torque to media drive member 20 in a first direction and for directing motor 26 to apply torque to media drive member 24 in a second opposite direction to facilitate sheet separation. As will be described hereafter, memory 62 further includes instructions for processor 60 for generating control signals to adjust the operation of motor 26 in response to detection of multiple sheets of media being picked. Controller 38 is not limited to any specific combination of hardware circuitry and software, nor to any particular source for the instructions executed by the processing unit.

Sensor 40 comprises a device configured to detect or sense one or more characteristics of sheets 12 of media being picked by pick device 18. Sensor 40 is further configured to communicate such sensed data to controller 38. Based upon the detected one or more characteristics of sheets 12 of media, controller 38 generates control signals varying torque applied by motor 22 and/or motor 26 to media drive member 20 and/or media drive member 24 to separate multiple sheets 12 that have been picked by pick device 18. For example, in one embodiment, controller 38 may generate control signals such that motor 26 applies a first torque in the direction indicated by arrow 54 to media drive member 24 in response to sensor 40 detecting a first type of media being picked by media device 18 and may generate control signals directing motor 26 to alternatively supply a second distinct torque to media drive member 24 in the direction indicated by arrow 54 in response to sensor 40 detecting a second distinct media within media input 16 and being picked by pick device 18. In yet other embodiments, sensor 40 may be omitted.

Input 42 comprises one or more devices configured to facilitate input of information identifying a type or characteristic of media within input 16 being picked by pick device 18 and/or information relating to at least one characteristic of the media being picked by pick device 18. Based upon such input information, controller 38 may adjust the operation of motor 26 and/or motor 22 such that appropriate torque is selectively applied to media drive member 24 and/or media drive member 20, respectively, to enhance separation of multiple sheets when device 18 had undesirably picked multiple sheets from input 16. In those embodiments in which input 42 facilitates inputting of information identifying media within input 16 being picked by pick device 18, controller 38 may consult memory 62 for a predetermined torque that should be supplied to one or both of media drive members 20 and 24 by motors 22 and 26, respectively, based upon the input identification of the media being picked by pick device 18. For example, memory 26 may comprise a look-up table including different voltages for different types of potential media that may be picked by pick device 18. Based upon the input identification of media, controller 38 generates control signals supplying the selected voltages to motor 22 and/or motor 26 to apply the appropriate torque or torques to media drive members 20 and 24, respectively.

In other embodiments, memory 62 may comprise a look-up table including one or more characteristics associated with each of a multitude of distinct media types that may be picked by pick device 18. In such an embodiment, controller 38 may calculate a desired amount of torque to be applied to motor 22 and/or motor 26 based upon those media characteristics taken from the table that correspond to the input identification of the media within input 16. In other embodiments, in lieu of including a look-up table with such information, memory 62 may include a look-up table containing torque or predetermined torque values or predetermined voltage levels that correspond to varying potential characteristics of media being picked by pick device 18. In such an embodiment, controller 38 may generate control signals resulting in motor 22 and/or motor 26 applying the torque values to drive members 20 and 24, respectively, taken from the table that correspond to the input characteristics of the media within media input 16 or from the aforementioned other look-up table based upon the input identification of the media within input 16.

In still other embodiments, controller 38 may alternatively be configured to calculate a torque to be supplied to media drivers 20 and 24 by motors 22 and 26, respectively, based upon either the media characteristics taken from the look-up table that correspond to the input media identification or based directly upon input media characteristics. Although memory 62 has been described as potentially using a look-up table, memory 62 may include other memory storage mechanisms for storing media characteristics, torques or voltage levels corresponding to various values or data that may be input through input 42.

Input 42 may comprise any of a variety of devices facilitating input of information by a person. For example, in one embodiment, input 42 may comprise a keyboard, mouse, stylus, touch screen or touch pad, microphone and the like. In still other embodiments, input 42 may comprise a device configured to facilitate communication between system 10 and another auxiliary device such as a network, computer and the like to communicate identification of the media or one or more characteristics of the media within media input 16 to system 10. In other embodiments, input 42 may be omitted.

According to one embodiment, the torque applied to media drive member 20 by motor 22 is greater than the torque applied to media drive member 24 by motor 26. The difference between the torques applied by motors 22 and 26 is chosen such that when a single sheet 12 of medium is between drive members 20 and 24, media drive member 24 rotates in a direction opposite to the direction 54 in which torque is applied by motor 26. As a result, the single sheet 12 of medium disposed between drive members 20 and 24 is driven by member 20 towards media interaction device 36.

The torques applied by motors 22 and 26 to media drive members 20 and 24 are also chosen, in some embodiments, such that when two or more sheets of sheets 12 of media are disposed between members 20 and 24, media drive member 20 engages and drives the uppermost sheet (as seen in FIG. 1) towards media interaction device 36. At the same time, media drive member 24 engages and drives at least a lower most sheet 12 of the multiple sheets in a direction opposite to that of the upper sheet and towards media input 16. As a result, the uppermost sheet and the lower most sheet (as seen in FIG. 1) are separated such that the lower most sheet is not fed to media interaction device 36 with the uppermost sheet.

Figure 2A:
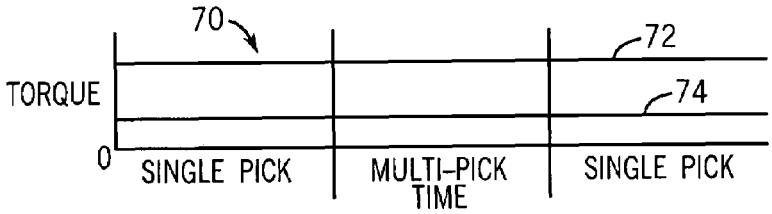
FIG. 2A is a graph illustrating one example mode of operation for the sheet separation system of FIG. 1 according to an example embodiment.

FIGS. 2A-2D schematically illustrate various modes of operation for system 10. FIG. 2A schematically illustrates mode 70 for system 10. As shown by FIG. 2A, controller 38 generates control signals such that motor 22 (shown in FIG. 1) applies a substantially constant torque 72 over time during picking of media to media drive 20 in the direction indicated by arrow 52 in FIG. 1. Controller 38 (shown in FIG. 1) generates control signals further directing motor 26 to apply a substantially constant torque 74 to media drive member 24 (shown in FIG. 1) in the direction indicated by arrow 54 in FIG. 1 over time. The torque 72 applied by motor 22 to media drive 20 is greater than the torque 74 applied to media drive 24 by motor 26. As shown by FIG. 2A, torque 72 and 74 remain substantially constant regardless of whether a single sheet ("single pick") is between members 20 and 24 or whether multiple sheets ("multi-pick") are between drive members 20 and 24. When operating under mode 70, system 10 may omit sensors 32 and 34 or other mechanisms for detecting occurrence of a multi-pick situation.

Figure 2B:
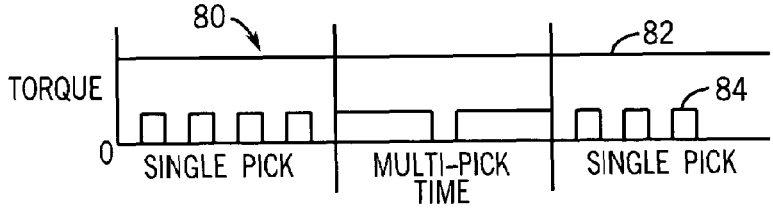
FIG. 2B is a graph illustrating another example mode of operation for the sheet separation system of FIG. 1 according to an example embodiment.

FIG. 2B schematically illustrates mode 80, another example mode of operation for system 10. As shown in FIG. 2B, controller 38 (shown in FIG. 1) generates control signals directing motor 22 to apply a substantially constant and uniform torque 82 over time to media drive member 20 in the direction indicated by arrow 52 in FIG. 1. At the same time, controller 38 generates control signals directing motor 26 to apply a non-uniform periodic torque 84 to media drive member 24 during picking of media in the direction indicated by arrow 54 in FIG. 1. In particular, during periods in which a single sheet 12 ("single pick") is disposed between members 20 and 24, controller 38 generates control signals directing motor 26 to apply torque 84 in a pulsed fashion, wherein the torque is applied at a first frequency having a first duty cycle. During periods of time in which multiple sheets 12 of media are disposed between media drive members 20 and 24 (a "multi-pick"), controller 38 generates control signals directing motor 26 to apply torque in a pulsed fashion, wherein the pulses of torque have a different frequency and/or a different duty cycle. In the example shown in FIG. 2B, during a multi-pick scenario, controller 38 generates control signals such that motor 26 applies pulses of torque at a reduced frequency but at a greatly enlarged duty cycle such that forces transmitted to one of the multiple sheets between members 20 and 24 for a greater percentage of time to facilitate separation of the sheets. In another example, controller 38 may alternatively generate control signals directing motor 26 to apply pulses of torque to media drive member 24 in the direction indicated by arrow 54 as seen in FIG. 1 where such pulses have the same frequency as those pulses of torque applied during a single pick scenario but wherein such pulses have a greater duty cycle.

Figure 2C:
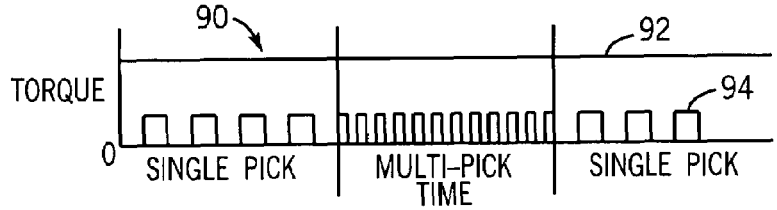
FIG. 2C is a graph illustrating another example mode of operation for the sheet separation system of FIG. 1 according to an example embodiment.

FIG. 2C illustrates mode 90, another example mode of operation for system 10. When operating under mode 90, controller 38 (shown in FIG. 1) generates control signals directing motor 22 to apply a substantially constant and uniform torque 92 over time to media drive member 20 in the direction indicated by arrow 52 in FIG. 1. At the same time, controller 38 generates control signals directing motor 26 to apply a non-uniform periodic pulsed torque 94 over time to media drive member 24 in the direction indicated by arrow 54 in FIG. 1. During periods of time when a single sheet is disposed between members 20 and 24 ("single pick"), the pulsed torque applied by motor 26 to media drive member 24 has a first frequency and a first duty cycle. As shown in FIG. 2C, when multiple sheets are disposed between members 20 and 24 (a "multi-pick"), controller 38 generates control signals such that the pulses of torque have a smaller duty cycle but a greater frequency. As a result, force is applied by media drive member 24 to one of the sheets between members 20 and 24 a greater percentage of time as compared to a single pick situation to further enhance separation of such multiple sheets. In another embodiment, controller 38 may alternatively generate control signals directing motor 26 to apply a pulsed torque having a greater frequency and the same or larger duty cycle as compared to the pulsed torque applied by motor 26 when a single sheet is disposed between members 20 and 24.

Figure 2D:
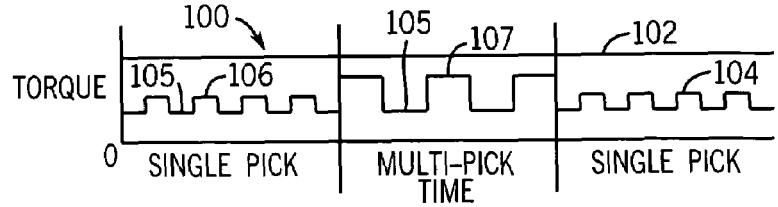
FIG. 2D is a graph illustrating another example mode of operation for the sheet separation system of FIG. 1 according to an example embodiment.

FIG. 2D schematically illustrates mode 100, another example mode of operation for system 10. When operating in mode 100, controller 38 (shown in FIG. 1) generates control signals directing motor 22 to apply a substantially constant and uniform torque 102 over time to media drive member 20 in the direction indicated by arrow 52 in FIG. 1. At the same time, controller 38 generates control signals directing motor 26 to apply a non-uniform periodic or pulsed torque 104 to media drive member 24 in the direction indicated by arrow 54 in FIG. 1. As shown by FIG. 2D, pulsed torque 104 pulses between a first lesser torque amount 105 and a second greater torque amount 106 when a single sheet is disposed between media drive members 20 and 24 ("single pick"). As further shown by FIG. 2B, during a multi-pick situation in which multiple sheets are engaged by members 20 and 24, pulsed torque 104 pulses between the first lesser torque amount 105 and a third greater torque amount 107. The torque value or amount 107 is greater than the torque value or amount 106 during the single pick scenario. The greater torque amount 107 facilitates separation of the multiple sheets. Although pulsed torque 104 is illustrated as having a substantially constant or uniform frequency and a constant or uniform work duty cycle over time during both single pick and multi-pick situations, pulsed torque 104 may alternatively have different frequencies and/or different work duty cycles during multi-pick occurrences as compared to single pick periods of time.

In modes 80, 90 and 100, controller 38 determines or detects a multi-pick scenario in which multiple sheets are being engaged by media drive members 20 and 24 based upon signals from sensor 28 indicating the velocity and direction in which drive member 24, the output shaft of motor 26 or any intermediate shafts between motor 26 and drive member 24 are rotating. For example, during a single pick scenario in which a single sheet is being simultaneously engaged by both members 20 and 24, the greater force applied by drive member 20 to the single sheet of media as compared to the force applied by drive member 24 will result in drive member 24, its intermediate shafts and the output shaft of motor 26 rotating in an opposite direction to the direction 54 in which torque is applied to drive member 24. In contrast, during a multi-pick scenario in which multiple sheets are engaged by drive members 20 and 24, such sheets will slip relative to one another, allowing the lesser torque applied to drive member 24 in the direction indicated by arrow 54 to cause rotation of drive member 24 also in the direction indicated by arrow 54 until drive member 24 once again engages the same sheet that is also being engaged by drive member 20. By sensing the direction of rotation of the output shaft of motor 26, drive member 24 and/or intermediate shafts using sensor 28, controller 38 (shown in FIG. 1) may identify a multi-pick situation and adjust the voltage being supplied to motor 26 so as to pulse width modulate motor 26 to vary the pulses of torque applied by motor 26 to drive member 24 as illustrated in FIGS. 2B, 2C and 2D. In other embodiments, controller 38 may detect a multi-pick situation based upon signals received from sensors 32 and 34.

Because controller 38 varies the percentage of time that torque is applied to drive member 24 in general opposition to the torque applied to drive member 20 based upon whether a single sheet or multiple sheets have been picked by pick device 18 and are being engaged by drive members 20 and 24, the total amount of counter torque applied by motor 26 may be reduced during single pick occurrences. As a result, the load upon motor 22 is reduced since drive member 20 is experiencing resistant torque either at a lower level (such as level 105 shown in FIG. 2D) or is experiencing counter torque for a smaller percent of time (as seen in FIGS. 2B and 2C) during periods of time in which a single sheet has been picked. As a result, energy savings are achieved and motor wear is reduced.

Overall, system 10, operating in any of the modes shown in FIGS. 2A, 2B, 2C and 2D or other modes, enables separation of multiple sheets to be enhanced for multiple types of media without disassembly or reconfiguration of system 10. To accommodate a different media, controller 38 generates different control signals causing different voltages to be applied to motor 26 such that motor 26 applies different levels of torque to media drive member 24 to account for differing characteristics of the different media. In one embodiment, controller 38 may generate such control signals based upon the type of media being picked based and upon instructions contained within memory 62 which itself may be portable in nature. In particular, memory 62 may comprise computer readable media containing instructions for the operation of system 10 for one or more particular types of media to be picked. When a different media is to be picked, different portions of memory 62 may be accessed or memory 62, when portable, may be removed and replaced by an alternative portable memory 62 containing instructions for directing controller 38 to appropriately control system 10 so as to accommodate the different media.

Figure 3:
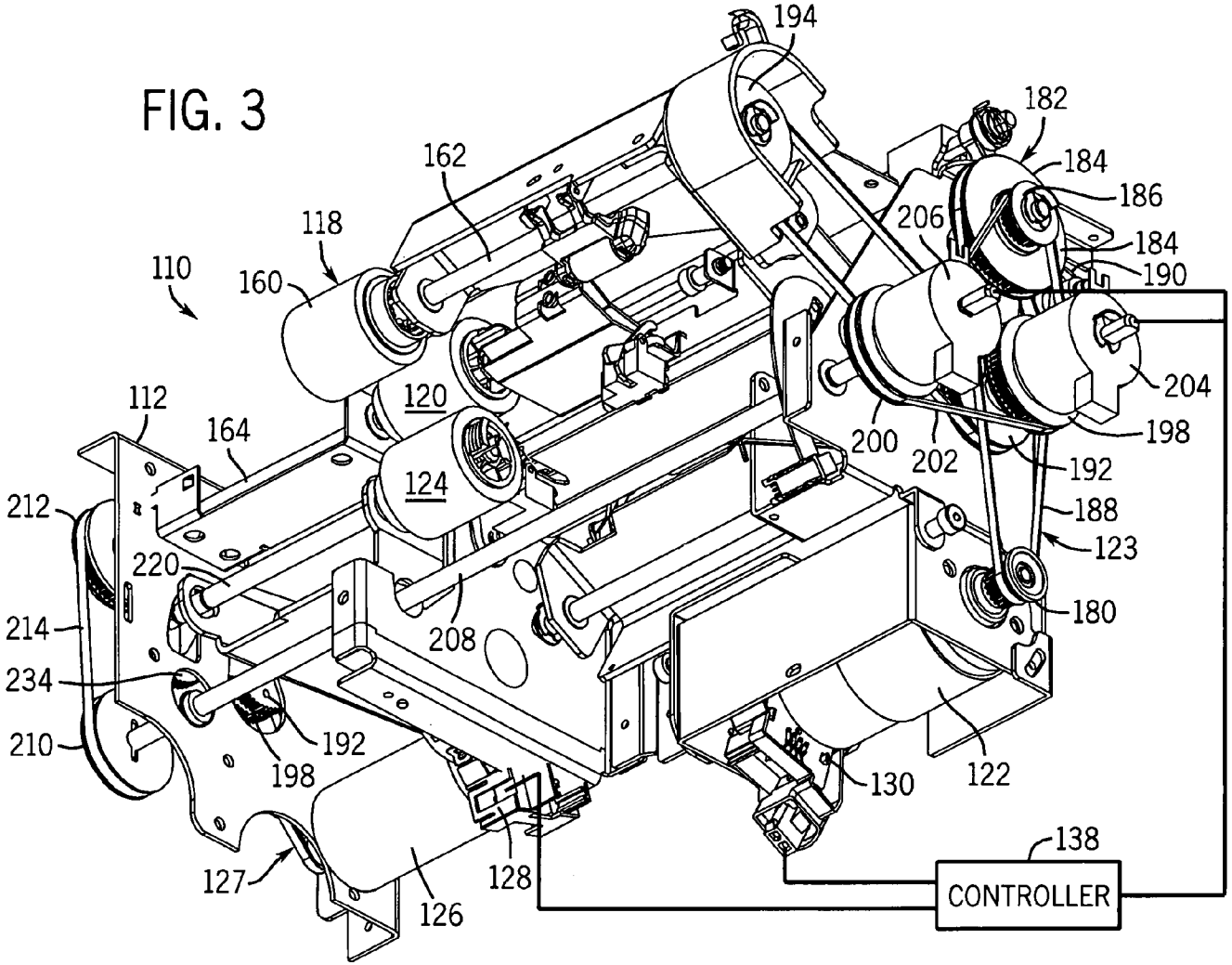
FIG. 3 is a bottom perspective view of an embodiment of the sheet separation system of FIG. 1 according to an example embodiment.
Figure 4:
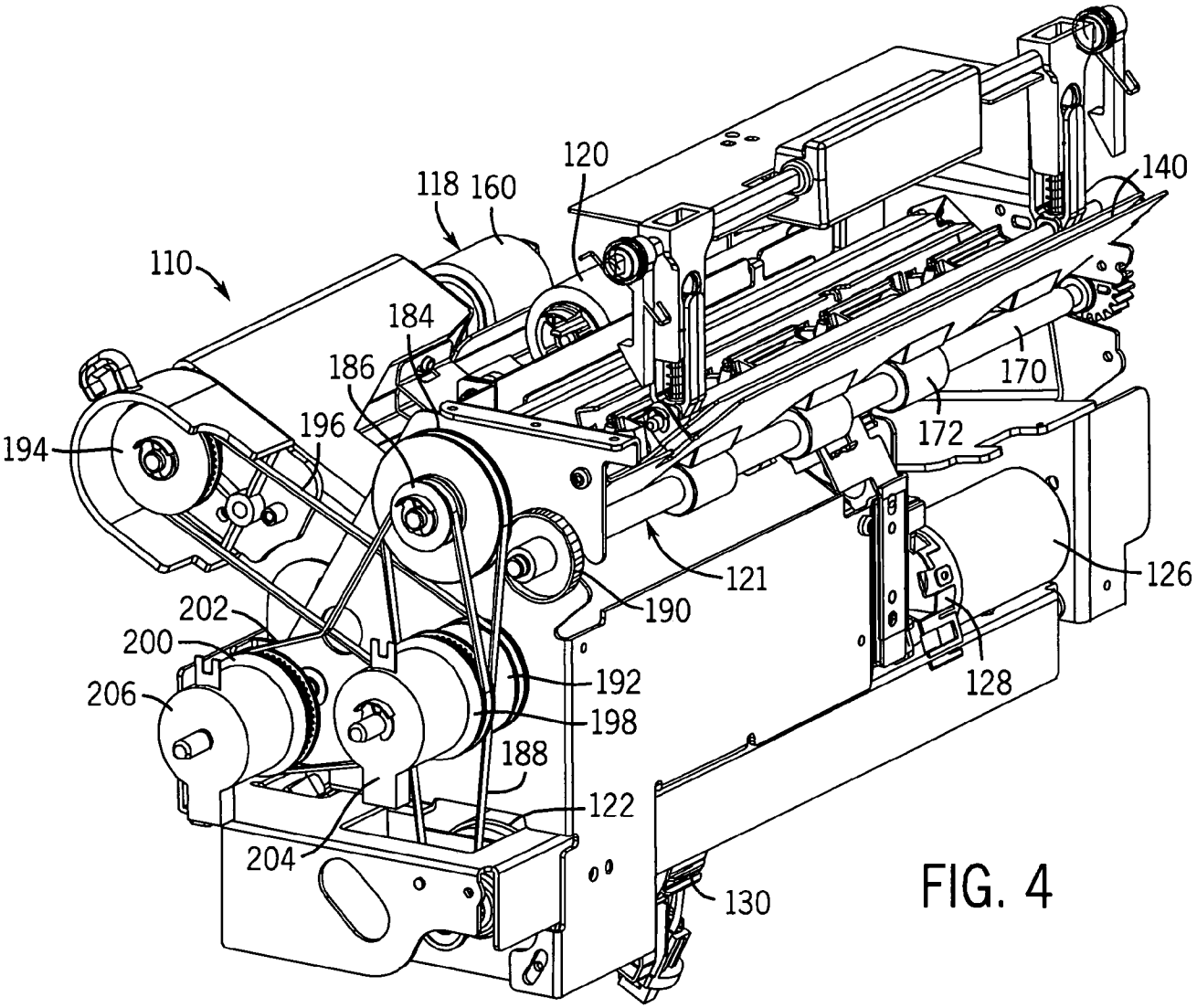
FIG. 4 is a top rear right perspective view of the sheet separation system of FIG. 3 according to an example embodiment.

FIGS. 3-6 illustrate sheet separation system 110, another embodiment of sheet separation and interaction system 10 of FIG. 1. System 110 is configured to separate sheets 12 from a stack 14 of media (shown in FIG. 6) and to transfer such separated sheets to a media interaction device such as media interaction device 36 shown and described with respect to FIG. 1. As shown by FIG. 3, sheet separation system 110 generally includes media input 16 (shown and described with respect to FIG. 1), frame 112, media pick device 118, media drive member 120, media transport 121 (shown in FIGS. 4-6), motor 122, transmission 123, media drive member 124, motor 126, transmission 127 (shown in FIG. 5), encoders 128 and 130 and controller 138 (schematically shown). Frame 112 comprises an arrangement of structures configured to house and support the remaining components of sheet separation system 110. For ease of illustration, certain components of frame 112, such as bearings and the like are omitted. Frame 112 is generally configured to be incorporated as part of a larger sheet separation and media interaction system. Frame 112 may have a variety of alternative shapes, sizes and configurations.

Figure 6:
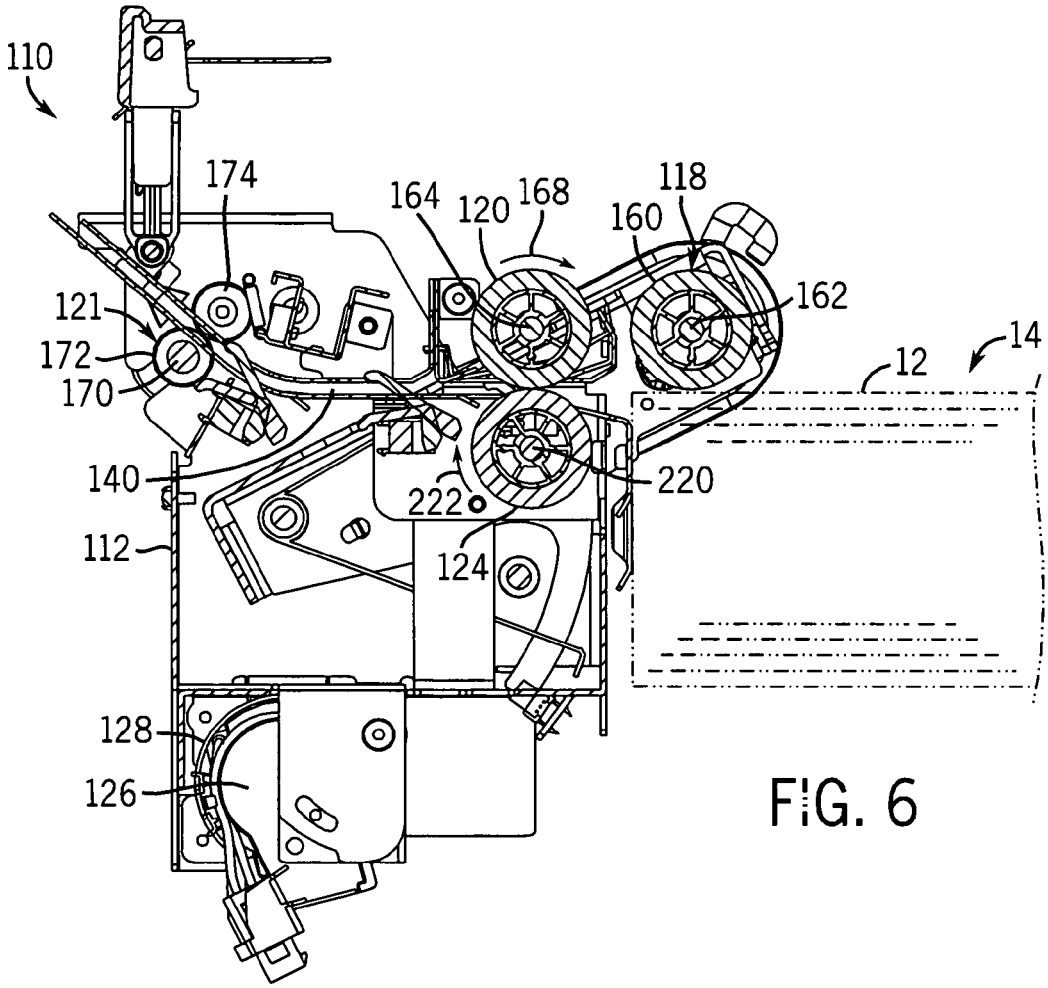
FIG. 6 is a sectional view of the sheet separation system of FIG. 5 according to an example embodiment.

Media pick device 118 comprises a pick tire 160 coupled to shaft 162 rotatably supported by frame 112. Pick tire 160 is rotatably supported opposite to a top or front most sheet 12 of media as seen in FIG. 6 such that rotation of pick tire 160 results in pick tire 160 frictionally engaging and moving the top or front most sheet towards media drive members 120 and 124. Although pick device 118 is illustrated as including a single pick tire 160, pick device 118 may alternatively include multiple pick tires or may include other structures, such as belts and the like, for frictionally engaging and moving a sheet 12 from a stack 14 towards media drive members 120 and 124.

Media drive member 120 comprises a tire or roller rotatably supported relative to frame 112 by a shaft 164. Media drive member 120 is configured to frictionally engage one face of the sheet of media picked by pick device 118 and to further move the sheet of media along media path 140. In particular, as seen in FIG. 6, member 120 is rotatably driven in the direction indicated by arrow 168. Although media drive member 120 is illustrated as a single cylindrical member or tire, media drive member 120 may alternatively include multiple tires or may include other structures such as belts and the like configured to engage and drive a sheet of media.

Drive member 121 (shown in FIGS. 4-6) comprises a member configured to engage and advance a sheet 12 of media along media path 140. In the particular example illustrated, media drive member 121 includes an elongate shaft 170 supporting a plurality of rollers 172 along media path 140. Rollers 172 are generally opposed by idler rollers 174 (shown in FIG. 6) along media path 140 for pinching sheets 12 of media therebetween. In other embodiments, media drive member 121 may include a greater or fewer number of such rollers 172, may comprise other structures configured to engage and drive media along media path 140 or may be omitted.

Motor 122 comprises a mechanism configured to apply torque to media drive member 120 in the direction indicated by arrow 168 in FIG. 6. In the particular example shown, motor 122 comprises a DC motor operably coupled to media drive member 120 by transmission 123. In the particular example illustrated, torque supplied by motor 122 is also transmitted to pick device 118 and media drive member 121 by transmission 123. In other embodiments, other motors may be utilized to transmit torque to pick device 118 and media drive member 121.

Transmission 123 transmits torque from motor 122 to drive member 121, pick device 118 and drive member 120. In the particular example illustrated, transmission 123 facilitates selective application of torque from motor 122 to pick device 118 and to media drive member 120. Transmission 123 generally includes pulley 180, cluster pulley 182 including pulleys 184 and 186 and a pinion gear (not shown), belt 188, pinion gear 190 (shown in FIG. 4), pulley 192, pulley 194, belt 196, pulley 198, pulley 200, belt 202, clutches 204, 206, pulley 210, pulley 212 and belt 214. Pulley 180 comprises a toothed pulley affixed to an output shaft of motor 122. Cluster pulley 182 comprises a toothed cluster pulley rotatably supported by frame 112 such that its pinion gear (not shown) is in meshing engagement with pinion gear 190. Belt 188 comprises a toothed belt extending about pulleys 180 and 184. Pinion gear 190 is fixed to shaft 170 of drive member 121 and is in meshing engagement with the pinion gear (not shown) of cluster pulley 182. As a result, torque supplied by motor 122 is transmitted by belt 188 to cluster pulley 182 and through its pinion gear to pinion 190 to rotatably drive media drive member 121 to further advance media along media path 140 (shown in FIG. 6).

Pulley 192 is rotatably supported by frame 112 and is configured to be selectively coupled to pulley 198 by clutch 204. Pulley 194 comprises a toothed pulley affixed to shaft 162 of pick device 118. Belt 196 comprises a toothed belt extending between pulleys 192 and 194 so as to transmit torque from pulley 192 to pulley 194. Upon being operably coupled to pulley 198 by clutch 204, pulley 192 is rotatably driven so as to rotatably drive pulley 194 and shaft 162 and so as to also apply torque to and rotatably drive pick tire 160.

Pulley 198 comprises a toothed pulley configured to freely rotate relative to pulley 192 or until selectively engaged to pulley 192 by clutch 204. Pulley 200 comprises a toothed pulley freely rotatable with respect to shaft 208 until being selectively engaged to shaft 208 by clutch 206. Belt 200 comprises a toothed belt extending between pulleys 186, 198 and 200. Clutches 204 and 206 comprise electric clutches configured to selectively connect pulley 198 to pulley 192 such that torque is transmitted from pulley 198 to pulley 192. Clutch 206 comprises an electric clutch configured to selectively connect pulley 200 to shaft 208 such that torque is transmitted from pulley 200 to shaft 208. In other embodiments, clutches 204 and 206 may comprise other clutch mechanisms configured to selectively operably couple pulleys 198 and 192 and pulleys 200 and shaft 208.

Figure 5:
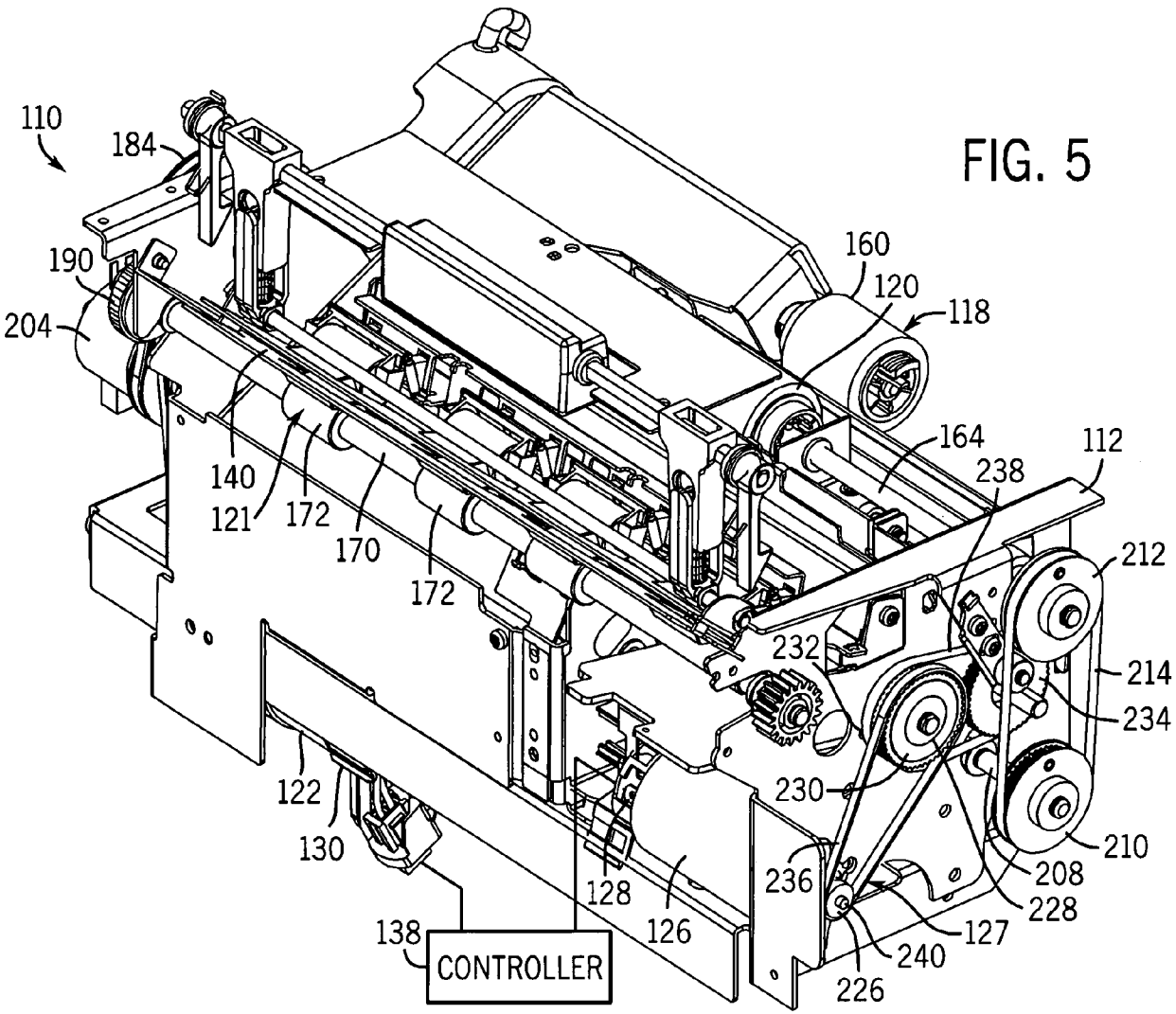
FIG. 5 is a top rear left perspective view of the sheet separation system of FIG. 3 according to an example embodiment.

As shown by FIG. 5, pulley 210 comprises a toothed pulley affixed to shaft 208 on an opposite side of system 110 as pulley 200. Pulley 212 comprises a toothed pulley affixed to shaft 164 which supports media drive member 120. Belt 214 extends between pulleys 210 and 212. As a result, when clutch 206 is engaged such that pulley 200 is operably connected to shaft 208, torque is transmitted by shaft 208 to pulley 210 and from pulley 210 to pulley 212 by belt 214 to rotatably drive shaft 164 and media drive member 120.

Although clutch 206 is illustrated as selectively operably connecting pulley 200 to shaft 208. Clutch 206 may alternatively be reconfigured so as to selectively operably connect pulley 212 to shaft 164 or to selectively operably connect pulley 210 to shaft 208. Although each of the pulleys and belts of transmission 123 are illustrated as being toothed, in other embodiments, such pulleys and belts may omit teeth. In still other embodiments, transmission 123 may alternatively include chain and sprocket arrangements or gear train assemblies for transmitting torque.

Media drive member 124 comprises a member configured to engage or frictionally contact a sheet of media extending between media drive member 120 and media drive member 124 and to apply force to the media in a direction opposite to the direction of force being applied to the one or more sheets of media by media drive member 120. In the particular example illustrated, media drive member 124 comprises a pick tire rotatably supported by shaft 220. In other embodiments, media drive member 124 may comprise multiple pick tires or may comprise other structures, such as belts, configured to frictionally engage and apply force to a sheet of media disposed between media drive members 120 and 124.

Motor 126 comprises a mechanism configured to supply torque to media drive member 124 in the direction indicated by arrow 222 as seen in FIG. 6. Motor 126 transmits torque to media drive member 124 via transmission 127 shown in FIG. 5. In the particular example illustrated, motor 126 comprises a DC motor. In other embodiments, motor 126 may comprise other devices configured to supply torque.

As shown by FIG. 5, transmission 127 generally includes pulley 226, cluster pulley 228 including pulleys 230 and 232, pulley 234 and belts 236, 238. Pulley 226 comprises a toothed pulley affixed to an output shaft 240 of motor 126. Cluster pulley 228 is rotatably supported by frame 112. Pulleys 230 and 232 of cluster pulley 228 comprise toothed pulleys. Pulley 234 comprises a toothed pulley affixed to shaft 220 which is coupled to media drive member 124. Belt 236 comprises a toothed belt extending between pulleys 226 and 230. Belt 238 comprises a toothed belt extending between pulleys 232 and 234. As a result, the torque supplied by motor 126 is transmitted to media drive member 124 through pulleys 226, 230, 232 and 234 and by belts 236 and 238. In other embodiments, transmission 127 may have other configurations for transmitting torque from motor 126 to media drive member 124. For example, in other embodiments, transmission 127 may alternatively include belt and pulley arrangements omitting teeth, chain and sprocket arrangements or gear train arrangements.

Encoders 128 and 130 comprise devices configured to sense a rotational direction and velocity of the output shafts of motors 122 and 126, respectively, and to transmit signals representing the sensed values to controller 138. In other embodiments, other sensing devices may be utilized in lieu of encoders 128 and 130 to sense rotational output of motors 122 and 126.

Controller 138 comprises a processing unit configured to generate control signals directing the operation of motor 122 and motor 126 based upon instructions contained within a memory, such as memory 62 illustrated and described with respect to FIG. 1. In the particular example shown, controller 138 is further configured to generate control signals directing the operation of clutches 204 and 206 to selectively transmit torque to pick device 118 and to media drive member 120.

Controller 138 generates control signals directing motor 122 and clutch 206 to transmit torque to media drive member 120 in a direction as indicated by arrow 168 in FIG. 6. At the same time, controller 138 generates control signals directing motor 126 to supply torque to media drive member 124 in the direction indicated by arrow 222 in FIG. 6. The torque supplied to media drive member 120 by motor 126 is generally greater than the torque supplied to media drive member 124 by motor 122. The difference between the torque supplied by motors 122 and 126 is chosen such that when a single sheet 12 of medium (shown in FIG. 6) is between drive members 120 and 124, media drive member 24 rotates in a direction opposite to the direction 222 in which torque is applied by motor 126. As a result, the single sheet 12 of medium disposed between drive members 120 and 124 is driven by member 120 towards media path 140. The torque supplied by motors 122 and 126 to media drive members 120 and 124, respectively, are also chosen such that when two or more sheets 12 of media are disposed between members 120 and 124, media drive member 120 engages and drives the uppermost sheet (as seen in FIG. 6) towards media path 140. At the same time, media drive member 124 engages and drives at least a lower most sheet 12 of the multiple sheets in a direction opposite to that of the upper sheet and away from media path 140. As a result, the uppermost sheet and the lower most sheet (as seen in FIG. 6) are separated such that the lower most sheet is not fed to media path 140.

According to one example embodiment, controller 138 generates control signals directing motor 126 to apply a substantially constant torque to media drive member 124 in the direction indicated by arrow 222 in FIG. 6 over time. In another embodiment, controller 138 may be configured to generate control signals directing motor 126 to supply a non-uniform periodic torque to media drive member 124 in the direction indicated by arrow 222 in FIG. 6. For example, controller 138 may generate control signals directing motor 126 to supply torque to media drive member 124 according to the modes illustrated and described with respect to FIGS. 2B-2D.

Overall, system 110 enables separation of multiple sheets to be enhanced for multiple types of media without disassembly or reconfiguration of system 10. To accommodate a different media, controller 138 may generate different control signals causing different voltages to be applied to motor 126 such that motor 126 applies different levels of torque to media drive member 124 to account for differing characteristics of different media. Because controller 138 may also be configured to generate control signals directing motor 126 to apply different levels of torque to media drive member 124 depending on whether a single sheet or multiple sheets have been picked by pick device 118, the total amount of counter torque applied by motor 126 may be reduced during single pick occurrences. As a result, the load upon motor 122 may be reduced since drive member 120 is experiencing resistant torque either at a lower level or is experiencing counter torque for a smaller percentage of time during periods of time in which a single sheet has been picked. As a result, energy savings are achieved and motor wear is reduced.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. A sheet separation system comprising:

a first sheet engaging surface;

a second sheet engaging surface, wherein the first surface and the second surface are configured to engage media therebetween;

a first motor to apply a first torque to the first sheet engaging surface in a first direction;

a second motor to apply a second torque to the second sheet engaging surface in a second direction opposite to the first direction, wherein the second torque is intermittently applied to the second sheet engaging surface during picking of a sheet; and a controller that generates control signals, wherein the second motor varies a percentage of time that the second torque is applied to the second sheet engaging surface as a sheet travels between the first sheet enraging surface and the second sheet engaging surface in response to the control signals.

2. The system of claim 1 further comprising a media supply, wherein the second motor applies the second torque to the second sheet engaging surface such that the second sheet engaging surface is adapted to apply a force to media to urge the media towards the media supply.

3. The system of claim 1, wherein the first torque is greater than the second torque.

4. The system of claim 1, wherein the second torque is selectively variable.

5. The system of claim 1 further comprising a controller that generates control signals, wherein the second motor varies a frequency at which the second torque is applied to the second sheet engaging surface in response to the control signals.

6. The system of claim 1 further comprising a media interaction device that interacts with the media.

7. The system of claim 1 further comprising a controller configured to generate control signals, wherein the first motor applies the first torque to the first surface in the first direction in response to the control signals and wherein the second motor applies the second torque to the second sheet engaging surface in the second opposite direction in response to the control signals.

8. The system of claim 1 further comprising a controller that generates control signals, wherein the second motor applies the second torque to the second sheet engaging the surface in a second direction opposite to the first direction in pulses during picking of a sheet in response to the control signals.

9. The system of claim 1 further comprising a controller that generates control signals, wherein the controller generates control signals causing the second motor to apply a third non-zero torque different than the second torque to the second sheet engaging surface during picking of a sheet in response to detection of multiple sheets concurrently between the first sheet engaging surface and the second sheet engaging surface.

10. The system of claim 1 further comprising a controller that generates control signals, wherein the control signals cause the second motor to apply a third non-zero torque different than the second torque in the second direction as a sheet travels between the first sheet engaging surface and the second sheet engaging surface.

11. The system of claim 10, wherein the controller consults a look-up table containing different torque values, including the second torque and the third torque, corresponding to different characteristics of sheets to be engaged by the first sheet engaging surface and the second sheet engaging surface.

12. The system of claim 1 further comprising:

a media feed tray;

a controller that generates control signals adjusting the second torque applied by the second motor based upon an identification of media in the media feed tray or at least one characteristic of the media in the media feed tray.

13. The system of claim 12 further comprising an input that receives an identification of media in the feed tray or a least one characteristic of media in the feed tray, wherein the controller generates the control signals that adjust the second torque based upon the identification of media in the feed tray or the at least one characteristic of media in the feed tray.

14. The system of claim 12 further comprising a sensor that senses at least one characteristic of media prior to the media passing between the first sheet engaging surface and the second sheet engaging surface, wherein the controller generates the control signals that adjust the second torque based upon the at least one characteristic sensed by the sensor.

15. The system of claim 1, wherein the controller generates control signals causing the second motor to vary the percentage of time that the second torque is applied to the second sheet engaging surface while a sheet passes between the first surface and the second sheet engaging surface by adjusting a frequency at which the second torque is applied to the second sheet engaging surface.

16. A sheet separation method comprising:

positioning at least one sheet between a first media engaging surface and a second media engaging surface;

applying a first torque in a first direction to the first surface with a first motor; and applying a second torque in a second opposite direction to the second surface with a second motor;

adjusting operation of the second motor, wherein the adjusting includes varying a percentage of time at which the second torque is applied as a sheet travels between the first sheet engaging surface and the second sheet engaging surface, wherein the second torque is intermittently applied to the second sheet engaging surface during picking of a sheet.

17. The method of claim 16 further comprising positioning the at least one sheet in a feed tray, wherein the second direction in which the second torque is applied is adapted to apply a force to the at least one sheet towards the feed tray and wherein the first torque is greater than the second torque.

18. The method of claim 17, wherein the second torque is intermittently applied to the second surface.

19. The method of claim 17, wherein the adjusting operation of the second motor is in response to detection of multiple sheets between the first surface and the second surface.

20. The method of claim 19, wherein the adjusting includes adjusting a frequency at which the second torque is applied.

21. The method of claim 19, further comprising applying a third torque distinct from the second torque with the second motor, wherein adjusting operation of the motor includes adjusting application of the third torque with respect to application of the second torque.

22. The method of claim 19 further comprising sensing rotation of the motor to detect multiple sheets between the first surface and the second surface.

23. The method of claim 17 further comprising adjusting operation of the first motor in response to detection of multiple sheets between the first surface and the second surface.

24. The method of claim 17 further comprising applying a third torque distinct from the second torque with the second motor in the second direction.

25. The method of claim 17, wherein the second torque applied by the second motor varies based upon media within the feed tray.

26. The method of claim 25 further comprising sensing of at least one characteristic of media in the feed tray.

27. The method of claim 25 further comprising inputting information identifying media or at least one characteristic of the media.

28. The method of claim 16 further comprising varying application of voltage to the second motor in response to detection of multiple sheets between the first media engaging surface and the second media engaging surface.

29. The method of claim 28, wherein varying the application of voltage to the second motor is based upon a characteristic of the sheets.

30. The method of claim 29 further comprising consulting a look-up table including different motor voltages for different characteristics of the sheets.

* * * * *

UNITED STATES PATENT AND TRADEMARK OFFICE

CERTIFICATE OF CORRECTION

PATENT NO. : 7,455,286 B2 
APPLICATION NO. : 11/169062
DATED : November 25, 2008
INVENTOR(S) : David K. Klaffenbach et al.

It is certified that error appears in the above-identified patent and that said Letters Patent is hereby corrected as shown below:

On the face page, in field (57), under "Abstract", in column 2, lines 1-2, delete "Various embodiments of a sheet separation system are disclosed." and insert -- First and second motors apply a first and second torque to first and second sheet engaging surfaces. The first torque and second torque are applied in opposite directions. The second torque is intermittently applied to the second sheet engaging surface during picking of a sheet. --, therefor.

In column 12, line 32, in Claim 1, delete "enraging" and insert -- engaging --, therefor.

In column 13, line 25, in Claim 13, delete "a" and insert -- at --, therefor.

In column 14, line 3, in Claim 16, after "surface" delete "," and insert -- ; --, therefor.

Signed and Sealed this

Eighteenth Day of August, 2009

David J. Kappos

David J. Kappos
*Director of the United States Patent and Trademark Office*